US011049442B2

(12) United States Patent
Lee et al.

(10) Patent No.: US 11,049,442 B2
(45) Date of Patent: Jun. 29, 2021

(54) DISPLAY APPARATUS AND CONTROLLING METHOD THEREOF

(71) Applicant: SAMSUNG ELECTRONICS CO., LTD., Suwon-si (KR)

(72) Inventors: Jaehyang Lee, Suwon-si (KR); Byeongcheol Hyeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/785,021

(22) Filed: Feb. 7, 2020

(65) Prior Publication Data

US 2020/0312228 A1 Oct. 1, 2020

(30) Foreign Application Priority Data

Mar. 29, 2019 (KR) ..... 10-2019-0036859

(51) Int. Cl.
*G09G 3/32* (2016.01)

(52) U.S. Cl.
CPC ..... *G09G 3/32* (2013.01); *G09G 2300/06* (2013.01); *G09G 2310/0202* (2013.01); *G09G 2320/0247* (2013.01); *G09G 2320/0295* (2013.01); *G09G 2330/12* (2013.01)

(58) Field of Classification Search
CPC ..... G09G 3/32; G09G 2300/06; G09G 2310/0202; G09G 2320/0247; G09G 2320/0295; G09G 2330/12; G09G 3/2022
See application file for complete search history.

(56) References Cited

U.S. PATENT DOCUMENTS

| | | | |
|---|---|---|---|
| 8,441,468 | B2 | 5/2013 | Miyazaki et al. |
| 8,558,463 | B2 | 10/2013 | Sato et al. |
| 9,142,163 | B2 | 9/2015 | Jin et al. |
| 9,333,914 | B2 | 5/2016 | Katsura |
| 9,881,545 | B2 | 1/2018 | Ha et al. |
| 9,947,283 | B2 | 4/2018 | Chen et al. |

(Continued)

FOREIGN PATENT DOCUMENTS

| | | | |
|---|---|---|---|
| JP | 2005-258259 | A | 9/2005 |
| JP | 5294036 | B2 | 9/2013 |

(Continued)

OTHER PUBLICATIONS

International Search Report (PCT/ISA/210) dated Jul. 14, 2020 issued by the International Searching Authority in International Application No. PCT/KR2020/004185.

(Continued)

*Primary Examiner* — Stacy Khoo
(74) *Attorney, Agent, or Firm* — Sughrue Mion, PLLC

(57) ABSTRACT

A display apparatus is provided. The display apparatus includes a display including a plurality of Light Emitting Diode (LED) elements and configured to display an image frame in a scan line; a driver configured to drive the plurality of LED elements in a Passive Matrix (PM) method; and a controller. The controller is configured to control the driver to apply an error detection signal in the scan line, detect whether there is an error in first LED elements among the plurality of LED elements in a first scan line, and detect whether there is an error in second LED elements among the plurality of LED elements in a second scan line.

20 Claims, 10 Drawing Sheets

(56) References Cited

U.S. PATENT DOCUMENTS

| | | | | |
|---|---|---|---|---|
| 10,170,070 | B2 | 1/2019 | Chen et al. | |
| 10,297,200 | B2 | 5/2019 | Kim et al. | |
| 2007/0085779 | A1* | 4/2007 | Smith | G09G 3/3216 345/76 |
| 2007/0285360 | A1 | 12/2007 | Lee et al. | |
| 2008/0246699 | A1* | 10/2008 | Oh | G09G 3/3208 345/76 |
| 2013/0155033 | A1 | 6/2013 | Jin et al. | |
| 2013/0314307 | A1 | 11/2013 | Lin et al. | |
| 2016/0078800 | A1* | 3/2016 | Ha | G09G 3/32 315/209 R |
| 2017/0221440 | A1 | 8/2017 | Chen et al. | |
| 2017/0309209 | A1 | 10/2017 | Kenmotsu et al. | |
| 2018/0197498 | A1 | 7/2018 | Chen et al. | |
| 2018/0247586 | A1* | 8/2018 | Vahid Far | G09G 3/2003 |

FOREIGN PATENT DOCUMENTS

| | | | |
|---|---|---|---|
| KR | 10-0784036 | B1 | 12/2007 |
| KR | 10-2013-0070206 | A | 6/2013 |
| KR | 10-2017-0003871 | A | 1/2017 |
| KR | 10-2017-0064177 | A | 6/2017 |
| KR | 10-2017-0064179 | A | 6/2017 |
| KR | 10-2017-0090978 | A | 8/2017 |

OTHER PUBLICATIONS

Written Opinion (PCT/ISA/237) dated Jul. 14, 2020 issued by the International Searching Authority in International Application No. PCT/KR2020/004185.

* cited by examiner

DISPLAY APPARATUS AND CONTROLLING METHOD THEREOF

CROSS-REFERENCE TO RELATED APPLICATION(S)

This application is based on and claims priority under 35 U.S.C. § 119 to Korean Patent Application No. 10-2019-0036859, filed on Mar. 29, 2019, in the Korean Intellectual Property Office, the disclosure of which is incorporated herein by reference in its entirety.

BACKGROUND

1. Field

The disclosure relates to a display apparatus and a controlling method thereof, and more particularly, to a method of detecting an error in an LED element.

2. Description of Related Art

The error detection method of an LED element is performed by applying a current to the LED element and thus, a blinking phenomenon in which the screen flickers occurs inevitably.

In the related art, the error detection of an LED element is performed in a plurality of scan lines in a single image frame, as such, a blinking phenomenon occurs frequently. Due to such frequent blinking phenomenon, user may feel discomfort in viewing an image.

SUMMARY

The disclosure provides a display apparatus that reduces a blinking phenomenon in which the screen flickers without compromising error detection accuracy.

According to an embodiment, there is provided a display apparatus that includes a display including a plurality of Light Emitting Diode (LED) elements and configured to display an image frame in a scan line; a driver configured to drive the plurality of LED elements in a Passive Matrix (PM) method; and a controller. The controller is configured to control the driver to apply an error detection signal in the scan line, detect whether there is an error in first LED elements among the plurality of LED elements in a first scan line, and detect whether there is an error in second LED elements among the plurality of LED elements in a second scan line.

The controller is further configured to control the driver to apply the error detection signal to the first scan line in one of a plurality of sub sections in a first image frame, and detect whether there is an error in the first LED elements included in the first scan line based on a first signal received from the driver, and control the driver to apply an error detection signal to the second scan line in one of a plurality of sub sections in a second image frame, and detect whether there is an error in the second LED elements included in the second scan line based on a second signal received from the driver.

The controller is further configured to adjust a time of applying the error detection signal to the first scan line based on brightness information.

The controller is further configured to identify the brightness information based on pixel information of the first LED elements and the second LED elements included in the first scan line and the second scan line, respectively, to which the error detection signal is applied.

The controller is further configured to detect whether there is an error in the first LED elements included in the first scan line in a first sub section from among a plurality of sub sections in a first image frame, and detect whether there is an error in the second LED elements included in the second scan line in a second sub section from among a plurality of sub sections in a second image frame.

The second image frame is a frame after a predetermined frame interval from the first image frame.

The controller is further configured to adjust the predetermined frame interval based on at least one of a location of an error, a number of errors and error type information of the first LED elements and the second LED elements, before the first image frame and the second image frame are displayed.

The controller is further configured to store error information including at least one of a location of an error, a number of errors and error type information of the first LED elements and the second LED elements in an internal memory or transmit the error information to an external device.

The controller is further configured to, based on detecting an error in the first LED elements, determine whether to apply the image signal to the first LED elements based on error type information of the first LED element.

The plurality of LED elements are Micro LED elements.

According to another embodiment, there is provided a controlling method of a display apparatus including displaying an image frame by applying an image signal in a scan line to a driver that drives a plurality of LED elements in a PM method; controlling the driver to apply an error detection signal in the scan line; detecting whether there is an error in first LED elements among the plurality of LED elements in a first scan line; and detecting whether there is an error in second LED elements among the plurality of LED elements in a second scan line.

The detecting whether there is an error in the first LED elements included in the first scan line includes applying the error detection signal to the first scan line in one of a plurality of sub sections in a first image frame, and detecting whether there is an error in the first LED elements included in the first scan line based on a first signal received from the driver. The detecting whether there is an error in the second LED elements included in the second scan line includes applying an error detection signal to the second scan line in one of a plurality of sub sections corresponding to a second image frame, and detecting whether there is an error in the second LED elements included in the second scan line based on a second signal received from the driver.

The method further includes adjusting a time of applying the error detection signal to the first scan line based on brightness information.

The adjusting the time of applying the error detection signal to the first scan line includes identifying the brightness information based on pixel information of the first LED elements and the second LED elements included in the first scan line and the second scan line, respectively, to which the error detection signal is applied.

The detecting whether there is an error in the first LED elements included in the first scan line includes detecting whether there is an error in the first LED elements included in the first scan line in a first sub section from among a plurality of sub sections in a first image frame. The detecting whether there is an error in the second LED elements included in the second scan line includes detecting whether there is an error in the second LED elements included in the second scan line in a second sub section from among a plurality of sub sections in a second image frame.

The second image frame is a frame after a predetermined frame interval from the first image frame.

The predetermined frame interval is adjusted based on at least one of a location of an error, a number of errors and error type information of the first LED elements and the second LED elements, before the first image frame and the second image frame are displayed.

The method further includes storing error information including at least one of a location of an error, a number of errors and error type information of the first LED elements and the second LED elements in an internal memory or transmitting the error information to an external device.

The method further includes, based on detecting an error in the first LED element, determining whether to apply the image signal to the first LED elements based on error type information of the first LED element.

The plurality of LED elements are Micro LED elements.

As described above, according to various embodiments, the blinking phenomenon, which causes the display screen to flicker, can be reduced without compromising the error detection accuracy and thus, it is possible to provide a user with a comfortable image viewing environment.

In addition, by analyzing the location information and the like of the LED element in which an error is detected based on the detected error information, it is possible to use such information to repair a display apparatus or prevent any possible resolution issues due to the error.

DETAILED DESCRIPTION

Figure 1:
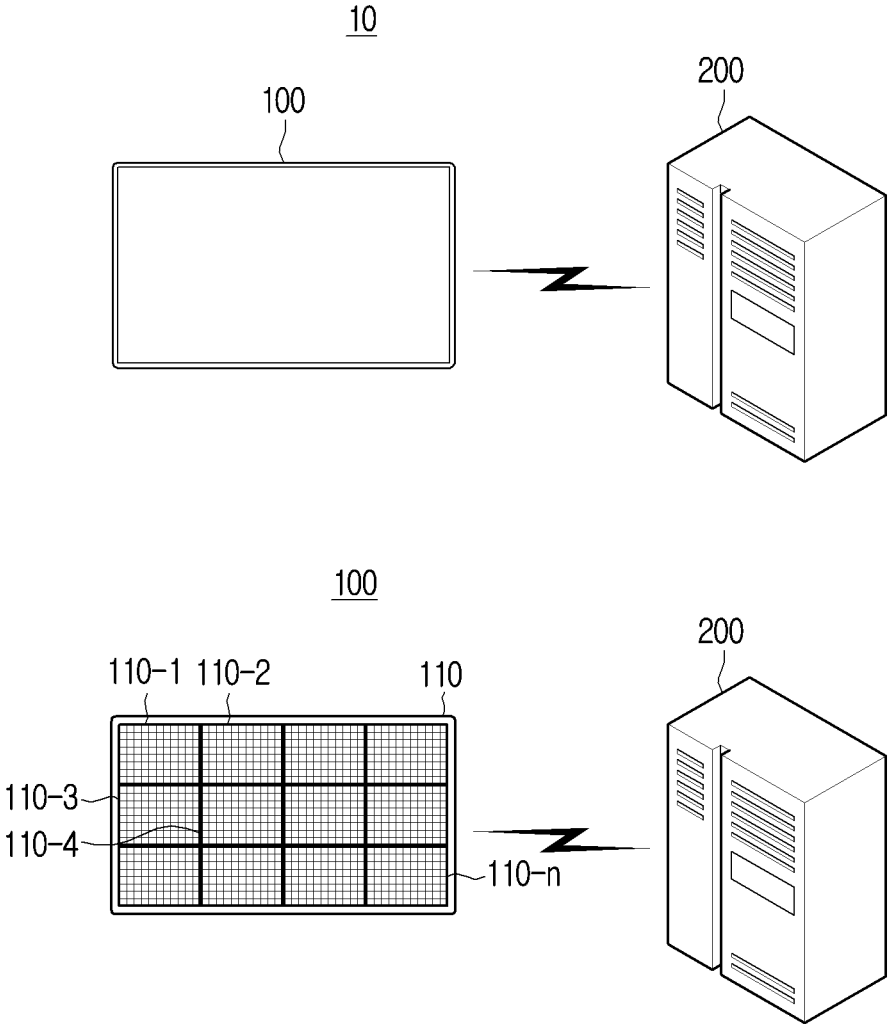
FIG. 1 is a schematic diagram provided to explain configuration of an electronic system according to an embodiment.

Hereinafter, the present disclosure will be described in detail with reference to the accompanying drawings.

The terms used in example embodiments will be briefly explained, and example embodiments will be described in greater detail with reference to the accompanying drawings.

Terms used in the present disclosure are selected as general terminologies currently widely used in consideration of the configuration and functions of the present disclosure, but may be different depending on the intention of those skilled in the art, a precedent, appearance of new technologies, and the like. Further, in specific cases, terms may be arbitrarily selected. In this case, the meaning of the terms will be described in the description of the corresponding embodiments. Accordingly, the terms used in the description should not necessarily be construed as simple names of the terms, but should be defined based on meanings of the terms and overall contents of the present disclosure.

The example embodiments may vary, and may be provided in different example embodiments. Various example embodiments will be described with reference to accompanying drawings. However, this does not necessarily limit the scope of the embodiments to a specific embodiment form. Instead, modifications, equivalents and replacements included in the concept and technical scope of the disclosure may be employed. While describing embodiments, if it is determined that the specific description regarding a known technology obscures the gist of the disclosure, the specific description is omitted.

Singular forms are intended to include plural forms unless the context clearly indicates otherwise. In the disclosure, the terms "include" and "comprise" designate the presence of features, numbers, steps, operations, components, elements, or a combination thereof, but do not exclude the presence or possibility of addition of one or more other features, numbers, steps, operations, components, elements, or a combination thereof.

In the description, the term "at least one of A or/and B" may include all possible combinations of the items that are enumerated together. For example, the term "at least one of A or/and B" means (1) including at least one A, (2) including at least one B, or (3) including both at least one A and at least one B.

Expressions "first", "second", or the like, used in the disclosure may indicate various components regardless of a sequence and/or importance of the components, will be used only in order to distinguish one component from the other components, and do not limit the corresponding components.

When it is mentioned that any component (for example, a first component) is operatively or communicatively coupled with/to or is connected to another component (for example, a second component), it is to be understood that any component is directly coupled with/to another component or may be coupled with/to another component through the other component (for example, a third component).

In the present disclosure, a 'module' or a 'unit' performs at least one function or operation and may be implemented by hardware or software or a combination of the hardware and the software. In addition, a plurality of 'modules' or a plurality of 'units' may be integrated into at least one module and may be at least one processor except for 'modules' or 'units' that should be realized in a specific hardware. In the disclosure, the term "user" may refer to a person who uses an electronic apparatus (or a display apparatus) or a device using an electronic apparatus (e.g., an artificial intelligence electronic device).

The example embodiments of the disclosure will be described in greater detail below in a manner that will be understood by one of ordinary skill in the art. However, embodiments may be realized in a variety of different configurations, and are not limited to descriptions provided herein.

Hereinafter, embodiments will be described in greater detail with reference to the accompanying drawings.

FIG. 1 is a schematic diagram provided to explain configuration of an electronic system according to an embodiment.

An electronic system 10 may include a display apparatus 100 and an external device 200.

Referring to FIG. 1, the display apparatus 100 according to an embodiment may include a plurality of self-luminous elements. Here, the self-luminous elements may be at least one of Light Emitting Diode (LED) or micro LED.

According to an embodiment, the display apparatus 100 may be implemented as a single panel (for example, a small display such as a smartphone) or may be implemented in the form in which a plurality of display modules are physically connected (for example, a large display such as a TV, etc.).

For example, the display module may be implemented as an LED module in which each of a plurality of pixels is implemented as an LED pixel or as an LED cabinet 110 in which a plurality of LED modules 110-1, 110-2, 110-3, 110-4, . . . **110-*n* are connected, but is not limited thereto. Furthermore, the display apparatus 100** may be implemented as liquid crystal display (LCD), organic LED (OLED) passive-matrix OLED (PMOLED), Plasma Display Panel (PDP), micro LED, display using quantum dot, and the like.

According to an embodiment, the display apparatus 100 may operate according to a Passive Matrix (PM) driving method. The PM driving method is a method of sequentially applying current or voltage by crossing a scan line with a horizontal electrode and a data line with a vertical electrode. According to the PM driving method, a signal may be transmitted to each scan line sequentially. For example, after a signal is transmitted to a scan line 1, the same or another signal may be transmitted to a scan line 2, which is the next line. In addition, the LED element to be turned on or off may be determined according to whether a signal is transmitted on the data line. That is, according to the PM driving method, when there is a voltage difference between the horizontal electrode and the vertical electrode, the corresponding LED element may be turned on, and when there is no voltage difference, the corresponding LED element may be turned off. On the other hand, unlike the PM driving method, an Active Matrix (AM) driving method may be implemented. The AM driving method may include a Thin Film Transistor (TFT) serving as a switch and a storage capacitor. Accordingly, in the AM driving method, even though the next scan line is selected, the previously turned-on LED element can be maintained for one frame without being turned off.

For the sake of description, the method of driving an LED element according to the various embodiments is based on the PM driving method.

The external device 200 may be implemented as a server that manages error information of the display apparatus 100, and may communicate with the display apparatus via wired or wireless manner. The external device 200 may receive error information of the LED element transmitted from the display apparatus 100, and may transmit A/S information to the display apparatus 100 based on the received error information, or control the display apparatus 100 remotely or perform a monitoring operation.

Specifically, the display apparatus 200 may detect whether there is an error in LED elements in a scan line unit and apply an error detection signal to a scan line, and Red (R), Green (G), and Blue (B) elements of the LED elements arranged in the scan line that may emit light. Here, the blinking phenomenon in which the display screen flickers may occur. However, various embodiments of the present disclosure may reduce the number of occurrences of the blinking phenomenon and increase the interval of occurrences of the blinking phenomenon so that a user does not recognize the blinking phenomenon. The various embodiments of the present disclosure will be described with reference to the accompanying drawings.

Figure 2:
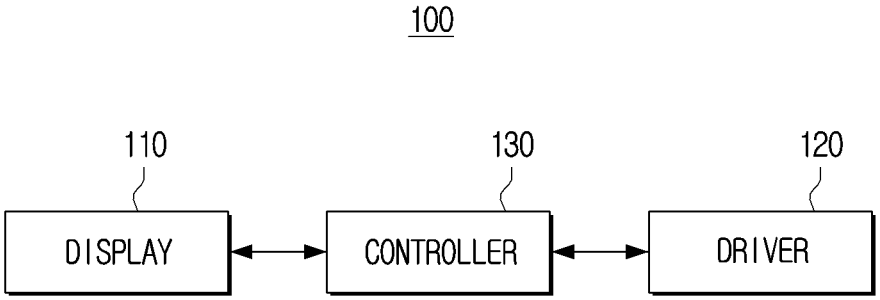
FIG. 2 is a block diagram provided to explain an operation of a display apparatus according to an embodiment.

FIG. 2 is a block diagram provided to explain an operation of a display apparatus according to an embodiment.

Referring to FIG. 2, the display apparatus 100 may include a display 110, a driver 120, and a controller 130.

The display 110 may include a plurality of LED elements. As described above, the display 110 may be implemented as a single panel display or a modular display.

The LED elements may be implemented as an RGB LED, and the RGB LED may include Red LED, Green LED and Blue LED. According to an embodiment, the LED elements may be implemented as micro LED. Here, the micro LED is an LED having a size of about 5 to 100 micrometers, and is a very small light emitting element that emits light by itself without a color filter.

The driver 120 may drive the display 110. For example, the driver 120 may drive each LED pixel by applying driving voltage or a driving current in order to drive each self-luminous element, for example, the LED pixel. Here, the driver 120 may drive the LED element in the PM method. In other words, the driver 120 may control the LED element by applying current or voltage sequentially by crossing the scan line with the horizontal electrode and the data line with the vertical electrode.

If the display 110 is implemented in the form of including a plurality of LED modules according to an embodiment, the driver 120 may include an LED driving module connected to each of the plurality of LED modules. However, this is only an example, and the driver 120 may be implemented as a single driving module that controls a plurality of LED modules. The LED driving module may transmit image data received from the controller 130 to a plurality of scan lines connected to each LED driving module and display an image corresponding to the image data on the display screen.

Furthermore, the driver 120 may adjust and output a supply time, intensity, and the like of the driving current supplied to the LED module to correspond to an input image signal.

Specifically, the LED driving module may control the LED module to output image data by sequentially scanning the image signal received from the controller 130 to each scan line, and the controller 130 may identify whether there is an error in the LED elements included in each scan line by detecting an error detection signal to the scan line under the control of the controller 130.

Alternatively, it may be assumed that the display 110 includes a plurality of display modules. For example, if four display modules are connected to form a display screen, the first to fourth partial images corresponding to each display module may be output simultaneously to form the entire image to be displayed. As such, the driving module corresponding to each display module may scan an image signal to a corresponding scan line simultaneously under the control of the controller 130. For example, the timing when an image signal is scanned to the first scan line of the first display module and the first scan line of the second display module may be the same. Accordingly, a user may recognize that the entire image in which a plurality of partial images are combined as a single image.

The driver 120 may include a power supply unit for supplying power. The power supply unit may be a hardware which converts an alternating current into direct current so that it can be stably used in the display 110 and supplies power to each component. The power supply unit may be largely composed of an input electromagnetic interference filter unit, an AC-DC rectifying unit, a DC-DC switching converter, an output filter and an output unit.

Here, the power supply unit may be implemented, for example, as a switched mode power supply (SMPS). The SMPS is a DC stabilized power supply that stabilizes the output by controlling the on-off time ratio of the semiconductor switch element, and enables driving of the display 110 at high efficiency, small size and light weight.

The controller 130 may control the overall operations of the signal processing of the display apparatus 100. The controller 130 according to an embodiment may be implemented as a Time controller (TCON) that transmits an image signal and an error detection signal to the driver 120. Alternatively, in some cases, the controller 130 may be disposed outside the display apparatus 100.

The controller 130 may control the driver 120 to apply an image signal in units of scan lines to display an image frame. Here, the scan line may refer to a line connected to the driver 120, to which voltage or current may be applied from the driver 120 to scan an image signal. A plurality of scan lines may be connected to one driver 120. A plurality of LED elements may be included in one scan line, and according to an image signal, Red (R), Green (G) and Blue (B) sub pixels of the LED elements included in the corresponding scan line may be turned on or turned off, respectively.

Figure 4:
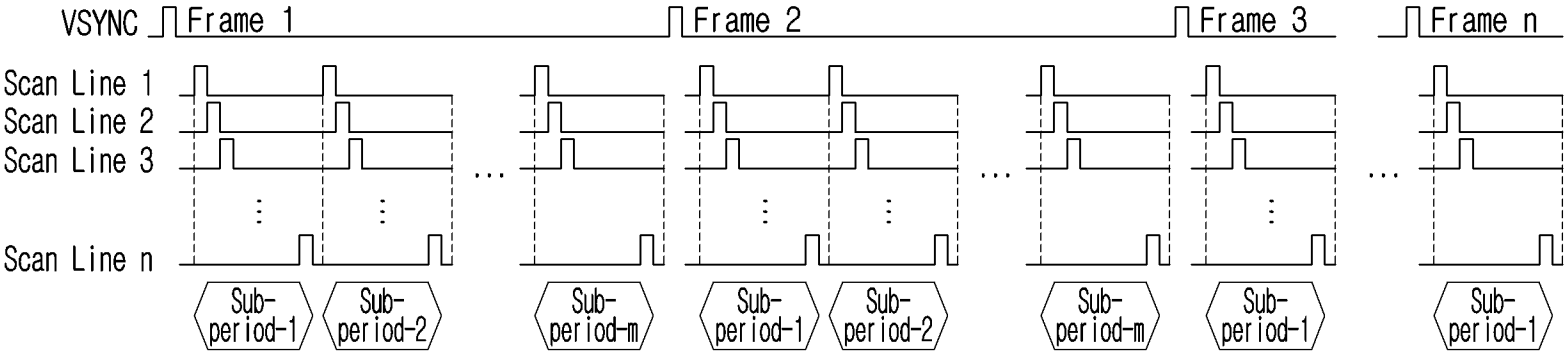
FIG. 4 is a diagram provided to explain a scan line, a sub section and an image frame according to an embodiment.

Referring to FIG. 4, if n scan lines are connected to one driver 120, an image signal may be sequentially input from the first scan line to the n-th scan line. Here, a period in which an image signal is all input from the first scan line to the nth scan line is called a sub period, and the sub period may be repeated a plurality of times to generate one frame. For example, if the frequency of an image signal is 60 hz, the sub period may be repeated 60 times to form one frame.

The controller 130 may detect whether there is an error in the LED elements included in the first scan line in one of a plurality of sub periods corresponding to the first image frame section, and may detect whether there is an error in the LED elements included in the second scan line in another one of a plurality of sub periods corresponding to the second image frame section.

Specifically, the controller 130 may control the driver 120 to apply an error detection signal to the first scan line in one of a plurality of sub periods corresponding to the first image frame section, and may detect whether there is an error in the LED elements included in the first scan line based on the signal received from the driver 120. In addition, the controller 130 may control the driver 120 to apply an error detection signal to the second scan line in one of a plurality of sub periods corresponding to the second image frame section, and may detect whether there is an error in the LED elements included in the second scan line based on the signal received from the driver 120. Here, the error detection signal is a trigger signal for starting an error detection in the scan line, and may be a signal for emitting an LED elements included in the scan line. The signal received from the driver 120 may be a signal including a voltage value measured in the corresponding scan line. The controller 130 may compare the voltage output through the scan line with predetermined voltage, and identify whether there is an error in the scan line based on the comparison result. For example, if the voltage value measured in the first scan line received from the driver 120 is less than the predetermined voltage, the controller 130 may identify that an error occurs in the first scan line because when an error occurs in the LED element, the voltage may be reduced to ground level.

The controller 130 may detect an error in one scan line from among a plurality of scan lines in units of image frames. For example, the controller 130 may detect whether there is an error in the LED elements included in the first scan line in the first sub period of the first image frame. Subsequently, the controller 130 may not detect whether there is an error in the separate LED elements in the remaining sub periods of the first image frame. Afterwards, the controller 130 may detect whether there is an error in the LED elements included in the second scan line in the first sub period of the second image frame.

Here, the second image frame may be a frame after a frame interval which is predetermined with reference to the first image frame. For example, the second image frame may be a frame immediately after the first image frame, but at least one frame may exist between the first image frame and the second image frame. In other words, the controller 130 may determine whether there is an error in the LED elements in one scan line from among a plurality of scan lines at predetermined frame intervals. For example, if the predetermined frame interval is three frames, the controller 130 may detect whether there is an error in the LED elements included in the first scan line in the first image frame, and subsequently, the controller 130 may detect whether there is an error in the LED elements included in the second scan line in the fourth image frame, without performing error detection in the second and third image frames.

The controller 130 may adjust the time at which an error detection signal is applied to the first scan line based on the brightness information of an image frame before displaying the first image frame.

If the brightness value of an image frame is relatively high, the controller 130 may increase the error detection time of the scan line. For example, by applying an error detection signal to the first scan line for a relatively long time, the LED included in the first scan line may emit light for a relatively long time. In addition, if the brightness value of an image frame is relatively low, the controller 130 may reduce the error detection time of the scan line.

For example, it may be assumed that an error detection signal is applied to a specific scan line, and there is no error in the LED elements disposed in the corresponding scan line. In this case, all of the R, G and B elements, which are subpixels of the LED elements disposed in the corresponding scan line, may emit light and thus, after the error detection signal is applied, white light may be output from the LED elements included in the scan line. Accordingly, if the brightness value of an image frame is relatively low, the output time of the white light may be reduced by reducing the detection time. For example, if the white light according to the error detection signal is output for a long time while a dark image is output due to a low brightness value of an image frame, a user may recognize the white light. Accordingly, the controller 130 may adjust the error detection time differently based on the brightness information of the image frame. Therefore, by reducing the error detection time, the user may not be able to visually recognize the white light in a dark image. On the other hand, even if the white light according to the error detection signal is output for a long time while a bright image is output due to a high brightness value of the third image frame, the user may not recognize the white light. In other words, the user may not recognize the blinking phenomenon due to the error detection of the LED elements and thus, user's viewing convenience may be not be significantly affected. Therefore, there may be less need to adjust the error detection time when a brighter image is displayed.

According to an embodiment, the controller 130 may identify the brightness information of the third image frame based on the pixel information of the LED elements included in the scan line to which the error detection signal is applied in the third image frame. Specifically, when detecting whether there is an error in the LED elements included in the first scan line of the first image frame, the controller 130 may identify the brightness information of the third image frame based on the pixel information of the LED elements included in the first scan line of the third image frame which is a frame immediately before the first image frame. Subsequently, the controller 130 may adjust the error detection time in the first scan line of the first image frame based on the brightness information of the third image frame.

Specifically, the controller 130 may identify the lowest value from among the pixel values of the LED elements included in the first scan line of the third image frame as the brightness information of the third image frame. For example, if ten LED elements are included in the first scan line, the controller 130 may identify the pixel values of each of the ten LED elements included in the first scan line of the third image frame, and may identify the smallest value as the brightness information of the third image frame. However, this is only an example, and the controller 130 may identify the average brightness value of the entire third image frame, the average brightness value of a specific scan line of the third image frame, a maximum brightness value of a specific scan line of the third image frame, etc. as the brightness information of the third image frame.

According to an embodiment, the controller 130 may detect whether there is an error in the LED elements included in the first scan line in the first sub period from among a plurality of sub periods corresponding to the first image frame section, and may detect whether there is an error in the LED elements included in the second scan line in the second sub period from among a plurality of sub periods corresponding to the second image frame section. In this case, if the period for detecting whether there is an error in the LED elements in each scan becomes longer, the possibility for a user not recognizing the blinking phenomenon according to the error detection of the LED elements may be increased.

According to another embodiment, the controller 130 may detect an error in units of scan lines in the section between image frames. In other words, the controller 130 may detect an error in units of scan lines in the section between the first image frame and the next image frame of the first image frame. For example, it is assumed that the predetermined frame interval is 0, that is, an error is detected in units of scans for each frame. In this case, in the section after the image output of the first image frame is finished and before the image output of the second image frame starts, the controller 130 may detect whether there is an error in the LED elements included in the first scan line by applying an error detection signal to the first scan line. Subsequently, in the section after the image output of the second image frame is finished and before the image output of the third image frame starts, the controller 130 may detect whether there is an error in the LED elements included in the second scan line by applying an error detection signal to the second scan line.

However, this is only an example, and the controller 130 may detect whether there is an error in the LED elements included in the first scan line in the first sub period from among a plurality of sub periods corresponding to the first image frame section, and may detect whether there is an error in the LED elements included in the second scan line in the first sub period from among a plurality of sub periods corresponding to the second image frame section. In other words, the controller 130 may detect whether there is an error in the LED elements in the first sub period from among a plurality of sub periods. Alternatively, the controller 130 may detect whether there is an error in the LED elements in the last sub period or in a random sub period from among a plurality of sub periods.

Meanwhile, each scan line may include a plurality of LED elements. A plurality of LED elements connected in parallel to one scan line are also connected to the data line which is a vertical electrode and thus, the location of the LED elements having an error in the one scan line can be identified. For example, when an error detection signal is applied to the third scan line, if the size of the voltage output through the 11th data line is less than a predetermined value, it may be identified that an error has occurred in the 11th LED element of the third scan line.

In addition, the controller 130 may adjust a predetermined frame interval based on at least one of the locations, the number or error type information of the LED elements where an error is identified in the image frame before the first image frame and the second image frame. For example, the controller 130 may store at least one of the locations, the number or error type information of the LED elements where an error is identified in a memory. The controller 130 may adjust a predetermined frame interval based on at least one of the locations, the number or error type information of the LED elements where an error is identified, which is stored in the memory. For example, if the number of the LED elements where an error is identified is equal to or greater than a predetermined number or the location of the LED elements where an error is identified is close, it is possible to detect an error of the LED elements included in the scan line at relatively shorter intervals by reducing the predetermined frame interval. In other words, if a user can recognize an error in the LED element, it is possible to increase the number of error detection by relatively reducing the error detection period. Accordingly, the controller 130 may increase the accuracy of the error detection by correcting an error which is identified by mistake, etc.

On the other hand, if the number of the LED elements where an error is identified is less than a predetermined number or the location of the LED elements where an error identified is not adjacent, that is, if it is difficult for a user to recognize the error of the LED elements, the error detection period may adjusted to be longer in order to properly identify the location of an error and to reduce the number of errors.

As such, by adjusting the number of error detection based on the error information, the number of unnecessary blinking may be reduced. Accordingly, the user's visual experience of the display may be improved.

In addition, the controller 130 may store error information including at least one of the locations, the number or error type information of the LED elements where an error is identified in an internal memory as described above. The error information regarding the LED element errors of the display apparatus 100 may be stored in the internal memory and accumulated in a database. The accuracy of the error detection can be improved based on the error information stored in the memory.

In addition, the controller 130 may transmit the error information to the external device 200. For example, if the number of the LED elements in which an error identified is equal to or greater than a predetermined number or the location of the LED elements where an error identified is adjacent or approximately close to the location where the user recognizes the error of the LED elements, the controller 130 may transmit the error information to the external device 200 and provide the error state of the display apparatus 100. Here, the external device 200 may be a server that manages the display apparatus 100 or a server of an A/S center. Alternatively, the external device 200 may be a processor that transmits the error information to an external server. Here, the processor may be a processor of an image processing apparatus that is implemented as a sending box, a control box, and a set-top box.

Meanwhile, the external device 200 may determine whether A/S is required based on the received error information and transmit feedback information including A/S information, etc. to the display apparatus 100. For example, the external device 200 may provide the display apparatus 100 or the user of the display apparatus 100 with information for inquiring about whether A/S is required, A/S schedules, etc.

Furthermore, the controller 130 may identify whether to apply an image signal to the identified LED element based on the error type information of the LED elements where an error is identified. For example, if the error type of the LED element where an error identified is an open type error, the controller 130 may not transmit a data signal to the corresponding LED element where an error is identified (zero masking). Accordingly, the LED element where an error is identified may not emit light. If the number of the LED elements to which a data signal is not transmitted or the LED elements are not adjacent to each other, a user may not recognize the error of the LED elements. Alternatively, the brightness of the peripheral LED elements of the LED element where an error is identified may be increased so that the user may not recognized the error of the LED element.

If the error type of the LED element where an error is identified is a short type error, the controller 130 may transmit the error information to the external device 200. This is because the short type error may be a type of error requiring repair.

The display 110 may be implemented as a plurality of display modules. For example, it may be assumed that four display modules are connected to form one screen. In this case, the first to the fourth partial images corresponding to each display module may be output simultaneously and the entire image may be displayed in the display 110. As such, the controller 130 may transmit image signals corresponding to the first to the fourth partial mages to the four display modules simultaneously so that the first to the fourth partial images are output simultaneously. For example, the timing at which the first scan line of the first display module and the first scan line of the second display module may be the same. In addition, an error detection signal may be applied to a specific scan line of each display module simultaneously.

Meanwhile, it is described that the controller 130 is an apparatus which is implemented as a time controller (TCON) for receiving image information and transmitting the same to the driver 120, but according to another embodiment, the controller 130 may be implemented as a controller in the driver 120 that controls the operation or timing of the driver 120 that projects an image signal or an error detection signal to each scan line.

The error detection of the above-described LED elements may be performed only when the error detection mode of the display apparatus 100 is turned on. For example, the error detection module may be always turned on when an image is output according to a user setting to identify whether there is an error in the LED element. Alternatively, the error detection mode may be turned on periodically.

Figure 3:
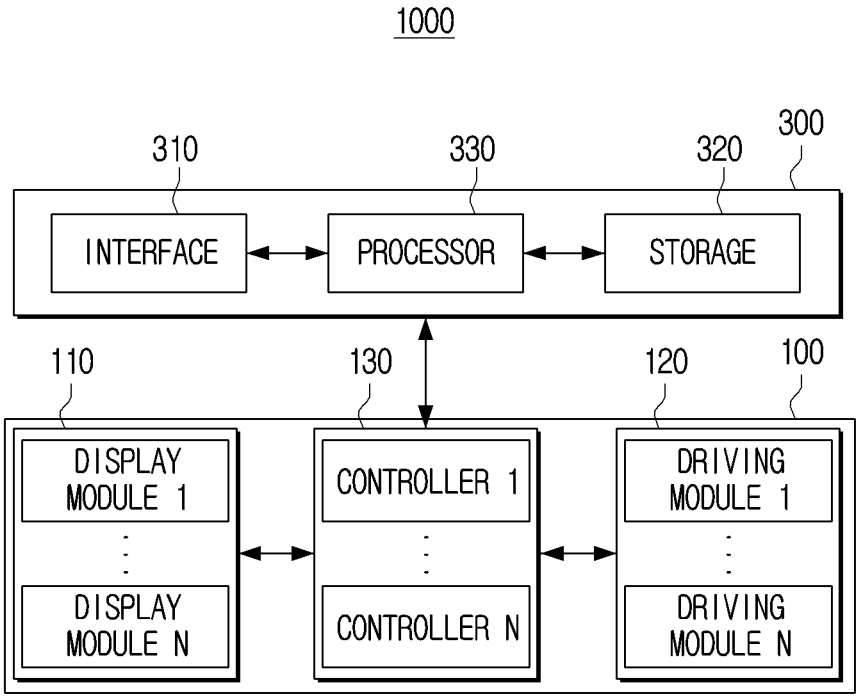
FIG. 3 is a block diagram illustrating configuration of a display system according to an embodiment.

FIG. 3 is a view illustrating configuration of a display system according to an embodiment.

A display system 1000 may include the display apparatus 100 and an image processing apparatus 300.

Here, it is assumed that the display apparatus 100 may include a plurality of display modules 110-1 . . . **110-*n*, the driver that operates the plurality of modules 110-1 . . . 110-*n* and a plurality of controllers 130-1 . . . 130-*n*. In other words, the display apparatus 100 in FIG. 3** is a modular display apparatus to which a plurality of cabinets are connected.

The controller 130 may obtain an image signal corresponding to the display 110 based on an input signal. Here, the input signal may be a signal regarding image information which is input. For example, if the display apparatus 100 is implemented as a cabinet connecting a plurality of LED modules, the input signal may be received from a processor 330 included in an external source box apparatus. Alternatively, if the display apparatus 100 is implemented as a TV of a single display module, the input signal may be received from a processor, that is, a main CPU.

The controller 130 may operate each LED pixel by applying driving voltage or driving current in order to drive the LED pixel constituting the display 110.

In addition, the image signal may be a signal including a clock signal or a data signal. In other words, the controller 130 may obtain a clock signal or a data signal corresponding to each of a plurality of modules based on an input signal.

Here, the clock signal may be a signal regarding time information for controlling the timing at which an image corresponding to a data signal is displayed, and may be output in the form of a square wave. The data signal may be a signal including data regarding an image to be displayed on the display apparatus 100. For example, the data signal may include a pixel value, brightness information, etc.

The controller 130 may control each of a plurality of LED modules based on a plurality of obtained image signals.

The controller 130 may transmit a clock signal and data to a driving module of each of the plurality of LED modules. Specifically, the controller 130 may transmit a clock signal to each of the plurality of LED modules through a clock signal transmission wire line, and transmit a data signal to each of the plurality of LED modules through a data transmission wire line. In other words, the controller 130 may transmit a clock signal and a data signal to the plurality of LED modules through separate wire lines.

However, the present disclosure is not limited thereto, and a clock embedding method for transmitting a clock signal and a data signal together through one transmission path or a method in which only a data signal is encoded and transmitted and a clock signal is obtained from the encoded data, not requiring a clock signal transmission wire line, etc. may be used.

The display apparatus 100 may further include a memory. The memory may store error information including at least one of the locations, a number, and error type information of the LED elements in which an error is identified. Based on the error information stored in the memory, the accuracy of the error detection may be improved.

The image processing apparatus 300 may include an interface 310, a storage 320 and the processor 330. Here, the image processing apparatus 300 may be implemented as a sending box, a control box, a set-top box, etc. which processes an input image signal and provides the same to the display apparatus 100.

The interface 310 may be connected to the display apparatus 100. Specifically, the interface 310 may be connected to the display apparatus 100 through a cable connected to a port. Here, the cable may be a High Definition Multimedia Interface (HDMI) cable. However, this is only an example, and the cable may be a Digital Visual Interface (DVI) cable, a Low Voltage Differential Signals (LVDS) cable, or an optical cable.

In addition, the interface 310 may be connected to the display apparatus 100 via wireless communication. In this case, the interface 310 may include a WiFi chip, a Bluetooth chip, a wireless communication chip, etc.

The storage 320 may store various data required for the operation of the image processing apparatus 300. In particular, the storage 320 may store image data received from an input apparatus. Here, the input apparatus may be a server, a set-top box, a USB storage, a PC, a smartphone, etc.

The storage 320 may be implemented as a non-volatile memory, a volatile memory, a hard disk drive (HDD) or a solid state drive (SSD), a memory card (e.g., micro SD card, USB memory, etc.) mounted on the image processing apparatus 300, an external memory (e.g., USB memory, etc.) connectable to an external input port, etc.

The processor 330 may control overall operations of the image processing apparatus 300.

Here, the processor 330 may include one or more of a central processing unit (CPU), a controller, an application processor (AP) or a communication processor (CP), and an ARM processor.

In addition, the processor 330 may include a graphic processing unit for graphic processing corresponding to an image. The processor 330 may be implemented as a System On Chip (SoC) including a core and a GPU. In addition, the processor 330 may include a single core, a dual core, a triple core, a quad core, and a core of a multiple thereof.

According to an embodiment, the processor 330 may transmit an input image which is input from an input apparatus to the display apparatus 100 through the interface 310. Specifically, the processor 330 may process an input image to obtain a signal corresponding to each of the displays 110 and provide the obtained signal to the controller 130. Subsequently, the controller 130 may control the plurality of display modules 110-1 . . . **110-*n* and the driver 120** to display an image corresponding to the signal on the screen of the display.

The image processor apparatus 300 is described separately from the display apparatus 100, but the image processing apparatus 300 may be included in the display apparatus 100 to form a single apparatus. In other words, the processor 330 may be included in the display apparatus 100 to be implemented as a single apparatus.

FIG. 4 is a diagram provided to explain a scan line, a sub section and an image frame according to an embodiment.

In FIG. 4, it may be assumed that a predetermined frame interval is 0, that is, an error of the LED elements included in one scan line from among a plurality of scan lines is detected for each image frame.

The controller 130 may detect whether there is an error in the LED elements included in scan line 1 from among sub section 1 of frame 1. Specifically, the controller 130 may control the driver 120 to apply an error detection signal to scan line 1 from among sub section 1 of frame 1. If there is an error in the LED element included in scan line 1, the error may be detected based on the signal received from the driver 120. Then, the controller may output an image through the display 110 by applying the image signal without applying a signal for detecting an error in the LED elements during the remaining sub sections of frame 1.

Subsequently, the controller 130 may detect whether there is an error in the LED elements included in scan line 2 from among sub section 2 of frame 2. Specifically, the controller 130 may control the driver 120 to apply an error detection signal to scan line 2 from among sub section 2 of frame 2. If there is an error, the error in the LED elements included in scan line 2 may be detected based on the signal received from the driver 120.

The controller may detect whether there is an error in the LED elements in all of the plurality of scan lines by repeating the above-described process.

According to another embodiment, the controller 130 may detect an error in units of scan lines in a section between image frames. For example, it may be assumed that a predetermined frame interval is 0, that is, error detection is performed for each frame. In this case, the controller 130 may detect whether there is an error in the LED elements included in the first scan line by applying an error detection signal to the first scan line in a section where the image output of frame 1 ends and before the image output of frame 2 starts. Subsequently, the controller 130 may detect whether there is an error in the LED elements included in the second scan line by applying an error detection signal to the second scan line in a section where the image output of frame 2 ends and before the image output of frame 3 starts. The controller may detect whether there is an error in the LED elements in all of the plurality of scan lines by repeating the above-described process.

However, the present disclosure is not limited thereto, and various methods may be used to detect whether there is an error in the LED elements included in all of the plurality of scan lines.

Figure 5:
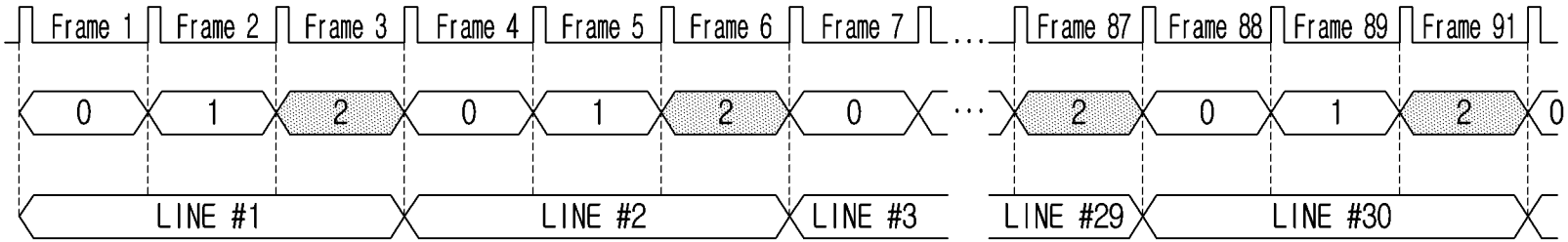
FIG. 5 is a diagram provided to explain a predetermined frame interval according to an embodiment.

FIG. 5 is a diagram provided to explain a predetermined frame interval according to an embodiment.

In FIG. 5, it is assumed that a predetermined frame interval is 2.

In this case, the controller 130 may detect whether there is an error in the LED elements included in scan line 1 of frame 3 without applying an error detection signal to the scan lines of frame 1 and frame 2. Subsequently, the controller 130 may detect whether there is an error in the LED elements included in scan line 2 of frame 6 without applying an error detection signal to the scan lines of frame 4 and frame 5.

In addition, the controller 130 may adjust an error detection time differently based on the brightness information of the image frame (e.g., the image frame 3) before another image frame (e.g., the image frame 1) for which error detection in the LED elements included in a scan line is to be performed.

For example, in FIG. 5, if whether there is an error in the LED elements included in the first scan line of frame 3 is to be detected, an error detection time of the first scan line of frame 3 may be adjusted based on the pixel information of the LED elements included in the first scan line of frame 2. For example, if the brightness of the LED elements included in the first scan line of frame 2 is relatively high, the controller 130 may relatively increase an error detection time of the first scan line of frame 3, and if the brightness of the LED elements included in the first scan line of frame 2 is relatively low, the controller 130 may relatively reduce an error detection time of the first scan line of frame 3.

Figure 6:
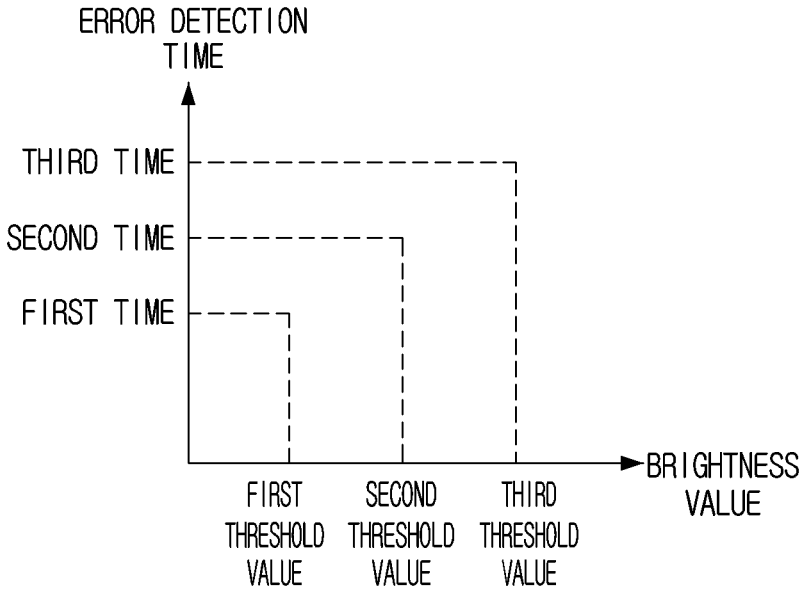
FIG. 6 is a chart provided to explain an adjustment of an error detection time according to an embodiment.

FIG. 6 is a chart provided to explain an adjustment of an error detection time according to an embodiment.

According to an embodiment, the controller 130 may identify the brightness information of the third image frame based on the pixel information of the LED elements included in the scan line to which an error detection signal is applied in the third image frame. Specifically, if whether there is an error in the LED elements included in the first scan line of the third image frame is to be detected, the controller 130 may identify the brightness information based on the pixel information of the LED elements included in the first scan line. The controller 130 may identify the lowest value of the pixel values of the LED elements included in the first scan line as the brightness information of the first scan line. For example, if 10 LED elements are included in the first scan line, the controller 130 may identify the pixel value of the 10 LED elements included in the first scan line, and identify the lowest value as the brightness information in the first scan line.

Meanwhile, the controller 130 may identify the minimum pixel value from among a plurality of LED elements included in the first scan line, and adjust an error detection time by comparing the identified minimum pixel value with a plurality of threshold values.

For example, if the minimum pixel value is less than the first threshold value, the controller 130 may identify an error in a plurality of LED elements included in the first scan line during one hour, if the minimum pixel value is equal to or greater than the first threshold value and less than the second threshold value, identify an error in the plurality of LED elements included in the first scan line during two hours which is longer than one hour, and if the minimum pixel value is equal to or greater than the second threshold value, identify an error in the plurality of LED elements included in the first scan line for three hours which is longer than two hours.

In general, the higher the brightness value, the larger the data size of the corresponding frame. The controller 130 may adjust an error detection time based on the data size of the previous frame. For example, if the data size of the previous frame is relatively large, an error detection time may be increased, and if the data size of the previous frame is relatively small, an error detection time may be decreased.

Figure 7:
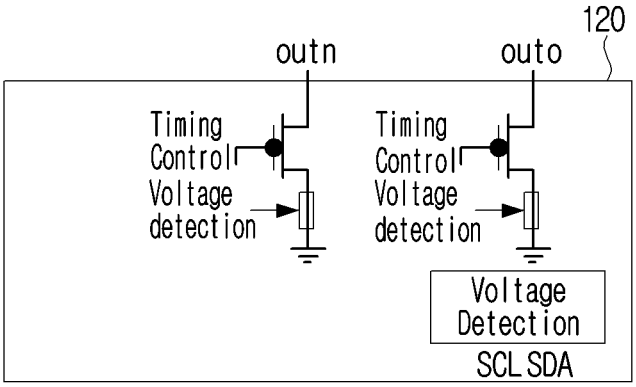
FIG. 7 is a circuit diagram provided to explain an operation of identifying an error of an LED element according to an embodiment.

FIG. 7 is a circuit diagram provided to explain an operation of identifying an error of an LED element according to an embodiment.

As illustrated in FIG. 7, the driver 120 may include a module for detecting voltage or current of a scan line, and provide a serial data transfer clock (SCL) and serial data (SDA) function for exchange of data.

The voltage detection module may measure a voltage value according to the application of an error detection signal, and as a result, the controller 130 may identify whether there is an error in the LED elements included in a scan line. For example, the controller 130 may identify whether there is an error in the LED elements by detecting the voltage value or whether current flows in each scan line through the voltage detection module. Specifically, the controller 130 may measure the voltage value of each scan line through the voltage detection module, compare the voltage value with a predetermined value, and detect whether there is an error in the LED elements included in the scan line base on the result of the comparison.

Figure 8:
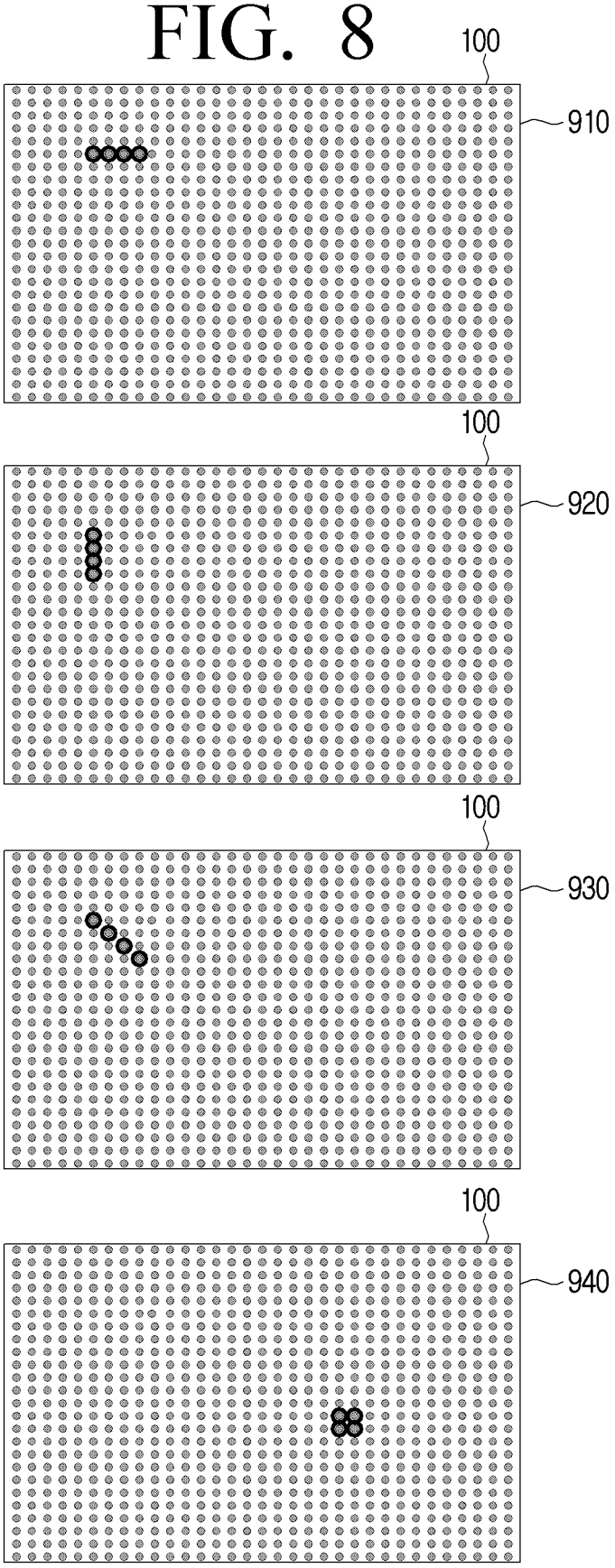
FIG. 8 is a schematic diagram provided to explain an arrangement of identified LED elements in which an error is detected according to an embodiment.

FIG. 8 is a schematic diagram provided to explain an arrangement of identified LED elements in which an error is detected according to an embodiment.

The display apparatus 100 may transmit error information to the external device 200. For example, the error information to be transmitted to the external device 200 may include the location and the number or the error type information of the LED elements in which an error is identified.

According to an embodiment, the display apparatus 100 may determine whether it is a case in which a user can identify whether there is an error in the LED element, and if it is determined that the user can identify whether there is an error in the LED element, transmit error information to the external device 200.

For example, if the number of LED elements in which an error is identified is equal to or greater than a predetermined number, the display apparatus 100 may determine that it is possible for a user to identify whether there is an error in the LED element. As another example, when the LED elements in which an error is identified are disposed adjacent to each other and thus, there is a problem for a user to view information because the errors are easily visible to the user, or when there a concern that the user's view may be disturbed, the display apparatus 100 may determine that it is possible for a user to identify whether there is an error in the LED elements.

FIG. 8 is a view illustrating that the LED elements in which an error is identified are disposed adjacent to each other and a predetermined number or more are identified. For example, an adjacent LED may have the same error as the error in the identified LED, and a user may identify whether there is an error in the LED element.

Specifically, an image 910 shows a case in which the LED elements with an identified error are consecutively adjacent in a horizontal direction. In other words, the errors of the LED elements occur continuously in the same scan line.

An image 920 shows another case in which identified errors are consecutively adjacent in a vertical direction in different scan lines.

An image 930 shows another case in which identified errors are generated in a diagonal direction, and an image 940 is yet another case in which the LED elements with identified errors are disposed adjacent to each other in a square form.

Accordingly, the display apparatus 100 may transmit the error information to the external device 200, and the external device 200 may provide information to inquire about whether A/S is required or when A/S is required for the display apparatus 100.

Figure 9:
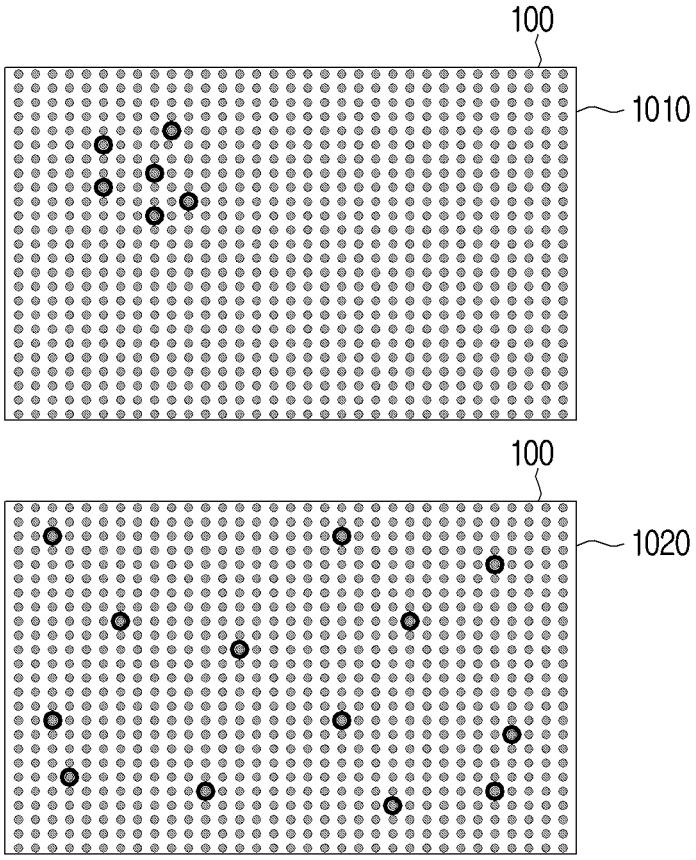
FIG. 9 is a schematic diagram provided to explain an arrangement of LED elements in which an error is detected according to another embodiment.

FIG. 9 is a schematic diagram provided to explain an arrangement of LED elements in which an error is detected according to another embodiment.

Here, an image 1010 shows a case in which the LED elements with identified errors are not consecutively adjacent to each other, but in a dispersed manner, which still causes a problem to a user's visibility in a dispersed manner. Thus, based on a number of identified errors, it may be determined that a user can identify whether there is an error in the LED element.

Accordingly, when the identified errors of the LED elements are more than a predetermined number in a specific unit area, the error information may be transmitted to the external device 200. For example, the width of the specific unit area or the predetermined number may be set individually based on the use form or size of the display apparatus 100.

In an image 1020, if the total number of the LED elements in which identified errors are equal to or greater than a predetermined number, the display apparatus 100 may transmit the error information to the external device 200. For example, if the predetermined number is 10, the display apparatus 100 may transmit the error information to the external device 200 since the total number of the LED elements in which an error occurs is 13 in the image 1020.

As described above, it is possible to determine whether a user may identify whether there is an error in the LED elements or whether repair is required for the display apparatus 100. Therefore, it is possible to manage the display apparatus 100 quickly and efficiently.

Figure 10:
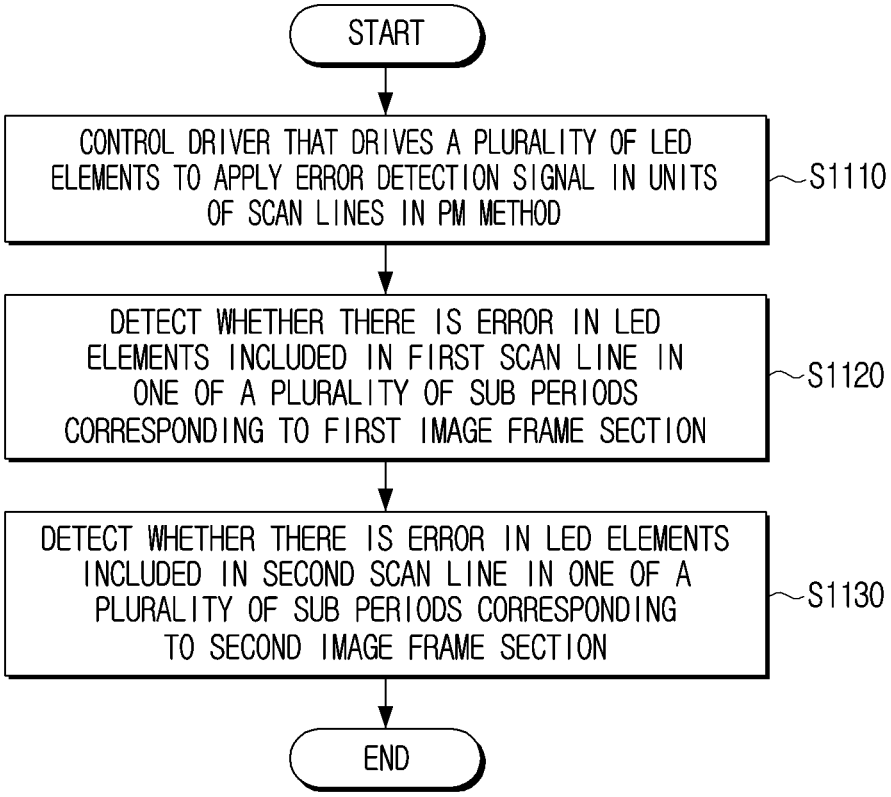
FIG. 10 is a flowchart provided to explain a controlling method of a display apparatus according to an embodiment.

FIG. 10 is a flowchart provided to explain a controlling method of a display apparatus according to an embodiment.

The display apparatus 100 may display an image frame by instructing the driver 120, which drives a plurality of LED elements, to apply an image signal in units of scan lines according to a PM method (S1110).

Specifically, the display apparatus 100 may apply an error detection signal to the first scan line in one of a plurality of sub sections corresponding to the first image frame section, and detect whether there is an error in the LED elements included in the first scan line based on a signal received from the driver.

The display apparatus 100 may detect whether there is an error in the LED elements included in the first scan line in one of a plurality of sub sections corresponding to the first image frame section (S1120).

Furthermore, the display apparatus 100 may apply an error detection signal to the second scan line in one of a plurality of sub sections corresponding to the second image frame section, and detect whether there is an error in the LED elements included in the second scan line based on a signal received from the driver.

According to an embodiment, the display apparatus 100 may detect whether there is an error in the LED elements included in the first scan line in the first sub section from among a plurality of sub sections corresponding to the first image frame section.

Furthermore, the display apparatus 100 may adjust a period for applying an error detection signal to the first scan line based on brightness information of an image frame.

Specifically, the display apparatus 100 may identify the brightness information of the image frame based on pixel information of the LED elements included in the scan line to which an error detection signal is applied.

According to an embodiment, the display apparatus 100 may detect whether there is an error in the LED elements included in the second scan line in the second sub section from among a plurality of sub sections corresponding to the second image frame.

The display apparatus 100 may detect whether there is an error in the LED elements included in the second scan line in one of a plurality of sub sections corresponding to the second image frame section (S1130).

Here, the second image frame may be a frame after a predetermined frame interval with reference to the first image frame. The predetermined frame interval may be adjusted based on at least one of the locations and the number or the error type information of the LED elements in an image frame before the first image frame and the second image frame.

The display apparatus 100 may store error information including at least one of the locations and the number or the error type information of the LED elements in an internal memory and/or transmit the error information to the external device 200.

In addition, the display apparatus 100 may identify whether to apply an image signal to an identified LED element based on the error type information.

The above-described plurality of LED elements may be Micro LED.

Meanwhile, methods according to the aforementioned various embodiments of the disclosure may be implemented in the form of software that can be installed on a conventional electronic apparatus (display apparatus).

Also, methods according to the aforementioned various embodiments of the disclosure may be implemented only with software upgrade, or hardware upgrade of conventional electronic devices.

In addition, methods according to the aforementioned various embodiments of the disclosure may be performed through an embedded server provided on an electronic device, or at least one external server of an electronic device.

According to an embodiment of the disclosure, the aforementioned various embodiments of the disclosure may be implemented as software including instructions stored in machine-readable storage media, which can be read by machines (e.g., computers). The machines may refer to devices that execute instructions stored in a storage medium, and operate according to the executable instructions, and the devices may include an electronic device according to the aforementioned embodiments. In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' may mean that a storage medium does not include signals, and is tangible, but does not indicate that data is stored in the storage medium semi-permanently or temporarily.

Also, according to an embodiment of the disclosure, methods according to the aforementioned various embodiments of the disclosure may be provided while being included in a computer program product. A computer program product may refer to a product, and it can be traded between a seller and a buyer. A computer program product can be distributed on-line in the form of a storage medium that is readable by machines (e.g., a compact disc read only memory (CD-ROM)), or through an application store (e.g., Play Store™). In the case of on-line distribution, at least a portion of a computer program product may be stored in a storage medium such as the server of the manufacturer, the server of the application store, and the memory of the relay server at least temporarily, or may be generated temporarily.

In addition, according to an embodiment of the disclosure, the aforementioned various embodiments of the disclosure may be implemented in a computer or a recording medium that can be read by a device similar to a computer by using software, hardware or a combination thereof. In some cases, the embodiments described in this specification may be implemented as a processor itself. Meanwhile, according to implementation by software, the embodiments such as procedures and functions described herein may be implemented as separate software modules. Each of the software modules may perform one or more functions and operations described herein.

In addition, computer instructions for performing processing operations of devices according to the aforementioned various embodiments of the disclosure may be stored in a non-transitory computer-readable medium. When computer instructions stored in such a non-transitory computer-readable medium are executed by the processor of a specific device, processing operations at devices according to the aforementioned various embodiments are made to be performed by the specific device.

A non-transitory computer-readable medium may refer to a medium that stores data semi-permanently, and is readable by machines, but not a medium that stores data for a short moment such as a register, a cache, and a memory. As specific examples of a non-transitory computer-readable medium, there may be a CD, a DVD, a hard disc, a blue-ray disc, a USB, a memory card, a ROM and the like.

Also, each of the components according to the aforementioned various embodiments (e.g., a module or a program) may consist of a singular object or a plurality of objects. In addition, among the aforementioned corresponding sub components, some sub components may be omitted, or other sub components may be further included in the various embodiments. Additionally, some components (e.g., a module or a program) may be integrated as an object, and perform the functions that were performed by each of the components before integration identically or in a similar manner. Operations performed by a module, a program, or other components according to the various embodiments may be executed sequentially, in parallel, repetitively, or heuristically. In addition, at least some of the operations may be executed in a different order, or omitted, or other operations may be added.

While embodiments of the disclosure have been shown and described, the disclosure is not limited to the aforementioned specific embodiments. It is apparent that various modifications can be made by those having ordinary skill in the art without departing from the gist of the disclosure as claimed by the appended claims, and such modifications are not to be interpreted independently from the technical idea or prospect of the disclosure.

What is claimed is:

1. A display apparatus comprising:

a display comprising a plurality of Light Emitting Diode (LED) elements and configured to display an image frame in a plurality of scan lines;

a driver configured to drive the plurality of LED elements in a Passive Matrix (PM) method; and a controller configured to:

control the driver to apply an error detection signal in the plurality of scan lines, detect whether there is an error in first LED elements among the plurality of LED elements in a first scan line among the plurality of scan lines in one of a plurality of sub sections in a first image frame, and detect whether there is an error in second LED elements among the plurality of LED elements in a second scan line among the plurality of scan lines in one of a plurality of sub sections in a second image frame.

2. The apparatus as claimed in claim 1, wherein the controller is further configured to:

control the driver to apply the error detection signal to the first scan line in the one of the plurality of sub sections in the first image frame, and detect whether there is an error in the first LED elements included in the first scan line based on a first signal received from the driver, and control the driver to apply the error detection signal to the second scan line in the one of the plurality of sub sections in the second image frame, and detect whether there is an error in the second LED elements included in the second scan line based on a second signal received from the driver.

3. The apparatus as claimed in claim 1, wherein the controller is further configured to adjust a time of applying the error detection signal to the first scan line based on brightness information.

4. The apparatus as claimed in claim 3, wherein the controller is further configured to identify the brightness information based on pixel information of the first LED elements and the second LED elements included in the first scan line and the second scan line, respectively, to which the error detection signal is applied.

5. The apparatus as claimed in claim 1, wherein the controller is further configured to:

detect whether there is an error in the first LED elements included in the first scan line in a first sub section from among the plurality of sub sections in the first image frame, and detect whether there is an error in the second LED elements included in the second scan line in a second sub section from among the plurality of sub sections in the second image frame.

6. The apparatus as claimed in claim 1, wherein the image frame comprises a plurality of image frames, and wherein the second image frame is a frame after a predetermined frame interval from the first image frame.

7. The apparatus as claimed in claim 6, wherein the controller is further configured to adjust the predetermined frame interval based on at least one of a location of an error, a number of errors and error type information of the first LED elements and the second LED elements, before the first image frame and the second image frame are displayed.

8. The apparatus as claimed in claim 1, wherein the controller is further configured to store error information including at least one of a location of an error, a number of errors and error type information of the first LED elements and the second LED elements in an internal memory or transmit the error information to an external device.

9. The apparatus as claimed in claim 1, wherein the controller is further configured to, based on detecting an error in the first LED elements, determine whether to apply an image signal to the first LED elements based on error type information of the first LED elements.

10. The apparatus as claimed in claim 1, wherein the plurality of LED elements are Micro LED elements.

11. A controlling method of a display apparatus comprising:

displaying an image frame by applying an image signal in a plurality of scan lines through a driver that drives a plurality of Light Emitting Diode (LED) LED elements in a Passive Matrix (PM) method;

controlling the driver to apply an error detection signal in the plurality of scan lines;

detecting whether there is an error in first LED elements among the plurality of LED elements in a first scan line among the plurality of scan lines in one of a plurality of sub sections in a first image frame; and detecting whether there is an error in second LED elements among the plurality of LED elements in a second scan line among the plurality of scan lines in one of a plurality of sub sections in a second image frame.

12. The method as claimed in claim 11, wherein the detecting whether there is an error in the first LED elements included in the first scan line comprises:

applying the error detection signal to the first scan line in the one of the plurality of sub sections in the first image frame, and detecting whether there is an error in the first LED elements included in the first scan line based on a first signal received from the driver, and wherein the detecting whether there is an error in the second LED elements included in the second scan line comprises:

applying the error detection signal to the second scan line in the one of the plurality of sub sections in the second image frame, and detecting whether there is an error in the second LED elements included in the second scan line based on a second signal received from the driver.

13. The method as claimed in claim 11, further comprising:

adjusting a time of applying the error detection signal to the first scan line based on brightness information.

14. The method as claimed in claim 13, wherein the adjusting the time of applying the error detection signal to the first scan line comprises identifying the brightness information based on pixel information of the first LED elements and the second LED elements included in the first scan line and the second scan line, respectively, to which the error detection signal is applied.

15. The method as claimed in claim 11, wherein the detecting whether there is an error in the first LED elements included in the first scan line comprises:

detecting whether there is an error in the first LED elements included in the first scan line in a first sub section from among the plurality of sub sections in the first image frame, and wherein the detecting whether there is an error in the second LED elements included in the second scan line comprises:

detecting whether there is an error in the second LED elements included in the second scan line in a second sub section from among the plurality of sub sections in the second image frame.

16. The method as claimed in claim 11, wherein the image frame comprises a plurality of image frames, and wherein the second image frame is a frame after a predetermined frame interval from the first image frame.

17. The method as claimed in claim 16, wherein the predetermined frame interval is adjusted based on at least one of a location of an error, a number of errors and error type information of the first LED elements and the second LED elements, before the first image frame and the second image frame are displayed.

18. The method as claimed in claim 11, further comprising:

storing error information including at least one of a location of an error, a number of errors and error type information of the first LED elements and the second LED elements in an internal memory or transmitting the error information to an external device.

19. The method as claimed in claim 11, further comprising:

based on detecting an error in the first LED elements, determining whether to apply the image signal to the first LED elements based on error type information of the first LED elements.

20. The method as claimed in claim 11, wherein the plurality of LED elements are Micro LED elements.

* * * * *